US005485960A

United States Patent [19]

Troudt

[11] Patent Number: 5,485,960

[45] Date of Patent: Jan. 23, 1996

[54] UNIVERSAL PAINT SPRAYER EXTENDER

[76] Inventor: Kevin J. Troudt, 6635 Devonshire Dr., Gladstone, Oreg. 97027

[21] Appl. No.: 277,216

[22] Filed: Jul. 18, 1994

[51] Int. Cl.[6] ..... B05B 15/06

[52] U.S. Cl. ..... 239/532

[58] Field of Search ..... 239/532, 754, 239/280, 280.5, 281, 289

[56] References Cited

U.S. PATENT DOCUMENTS

| | | | |
|---|---|---|---|
| 1,511,361 | 10/1924 | Paasche | 239/532 X |
| 1,745,972 | 2/1930 | Beck | 239/532 |
| 3,856,209 | 12/1974 | Hickson | 239/280 X |
| 3,915,382 | 10/1975 | Davis | 239/532 X |
| 4,023,711 | 5/1977 | Sena | 239/532 X |
| 4,744,519 | 5/1988 | Crowley | 239/532 |

FOREIGN PATENT DOCUMENTS

| | | | |
|---|---|---|---|
| 261350 | 1/1965 | Australia | 239/754 |
| 873766 | 6/1971 | Canada | 239/532 |
| 1259526 | 12/1961 | France | 239/280 |
| 2230148 | 7/1978 | Germany | 239/532 |

*Primary Examiner*—Andres Kashnikow
*Assistant Examiner*—Lesley D. Morris

[57] ABSTRACT

A paint spray gun extender, to which may universally be a paint spray gun having a handle and a trigger, providing a 360° adjustment in pitch, is achieved with a hollow extension pole and a cable running through the pole between a handle on one end and a spray gun mounting apparatus on its other end. The apparatus comprises a vertical support plate adjustably secured with a bolt and nut on which the plate pivots in face-to-face contact with a flat mounting portion on the pole end. A pivoting arm is secured to the distal end of the support plate to which is connected a cable running from the arm down the pole to an actuating control lever. An adjustable trigger actuator is provided on the arm extending over the plate for placement next to the spray gun trigger after gun angular orientation is set. On the support plate is a C-shaped grip member with its back secured to the support plate and its opposing legs extending away from the support plate into which a spray gun handle is secured with the trigger actuator next to the gun trigger, simulating a hand grasping the spray gun handle.

20 Claims, 5 Drawing Sheets

UNIVERSAL PAINT SPRAYER EXTENDER

BACKGROUND OF THE INVENTION

The present invention relates generally to paint spray applicators and more particularly to an extender to which a paint sprayer can be attached on one extender end and operated from its other end.

Painters have long recognized the need to apply paint beyond a painter's reach. Scaffolding and ladders are widely used to bring the painter to a position otherwise out of his reach. Extension poles are widely available for extending the paint applicator beyond the reach of one's arm instead of moving the painter. Paint rollers, sponges, and brushes typically fit onto the end of the extension pole, usually by a threaded pole end screwed into a matching threaded hole in the handle of the applicator.

Paint spray guns may also be mounted on the ends of extension poles, though not as easily as with threaded holes and pole ends. More involved mechanisms must be employed to firmly hold the spray gun or nozzle and to actuate the gun remotely. Prior art discloses previous attempts to mount a spray gun on the end of an extension pole, but all have proven less than desirable. U.S. Pat. No. 4,023,711 teaches an extension pole having a pivoting rectangular tube on its end into which a handle of a spray gun fits. A pin fits in front of the spray gun trigger and is pulled by a connected cable running from the gun to an actuator on the extension pole opposite end. The pivoting tube is mounted in the end of the extension pole with a pivot pin running through aligned holes in the tube and pole, necessarily limiting the range of pitch motion on the pivot pin to allow movement of the pivoting tube within the end of the pole. Presently available spray guns have trigger guards to protect against unintentional actuation of the gun trigger. The guard typically running to the bottom of the gun handle would prevent the gun handle from being received into the extension pole pivoting tube.

U.S. Pat. No. 4,744,519 teaches an extension pole slotted at a first end to pivotably receive a mounting plate with a pivot pin passing through aligned holes in the slotted pole end and the mounting plate. On the mounting plate is a U-shaped mounting bracket for receiving a spray gun handle. The bracket is pivotable upward away from the pole end but the range of downward pivot motion, or negative pitch, of the gun handle and bracket is limited by the pole, making it difficult to raise the spray gun over a surface, such as a beam, and point the gun downward toward the surface top.

SUMMARY OF THE INVENTION

The object of the present invention is to provide a paint spray gun extender that allows a wide range of positive and negative pivotable adjustment about a horizontal axis. This object is achieved with a vertical flat end member on a first end of an extension pole and a hole therethrough obtaining a 360° range of pitch motion. A vertical support plate with matching hole is mounted to the flat end member with a pivot pin passing through the aligned holes, held securely after adjustment by a tightening nut on the end of a pin threaded end. A C-shaped grip member is provided for placement around a paint spray handle, simulating a hand gripping the handle in a composable manner. By design then, if a hand can grasp the spray gun handle, so can the present grip member without the inherent limitations of the prior art. Thus, the support plate can fully rotate on the pivot pin about the flat end member substantially without limitation of movement, limitation presented only by the grip member as it reaches the extension pole in either direction of rotation.

To facilitate spray control, an adjustable trigger; actuator is provided on the support plate for placement next to the spray gun trigger after gun angular orientation is set. A control cable runs from the actuator along or inside the extension pole to an extension lever on a second end of the extension pole. When the lever is pulled, the cable likewise pulls the actuator against the spray gun trigger, depressing the trigger as required, as the actuator pivots on the support plate.

One skilled in the art will recognize the advantages taught by this invention and illustrated by the preferred embodiment presented. The specification and drawings are not intended to represent an exhaustive description of the invention. Obvious applications and extensions of the invention are intended to be within the spirit and scope of this invention.

FIG. **4*a*** is the grip member with decreasing curvature on one extending leg showing outlines of a large spray gun handle outward in the leg and a smaller spray gun handle more inward in the leg.

FIG. **4*b*** is an alternative embodiment of the grip member having each leg extending acutely from the grip back toward the opposing leg.

Figure 1:
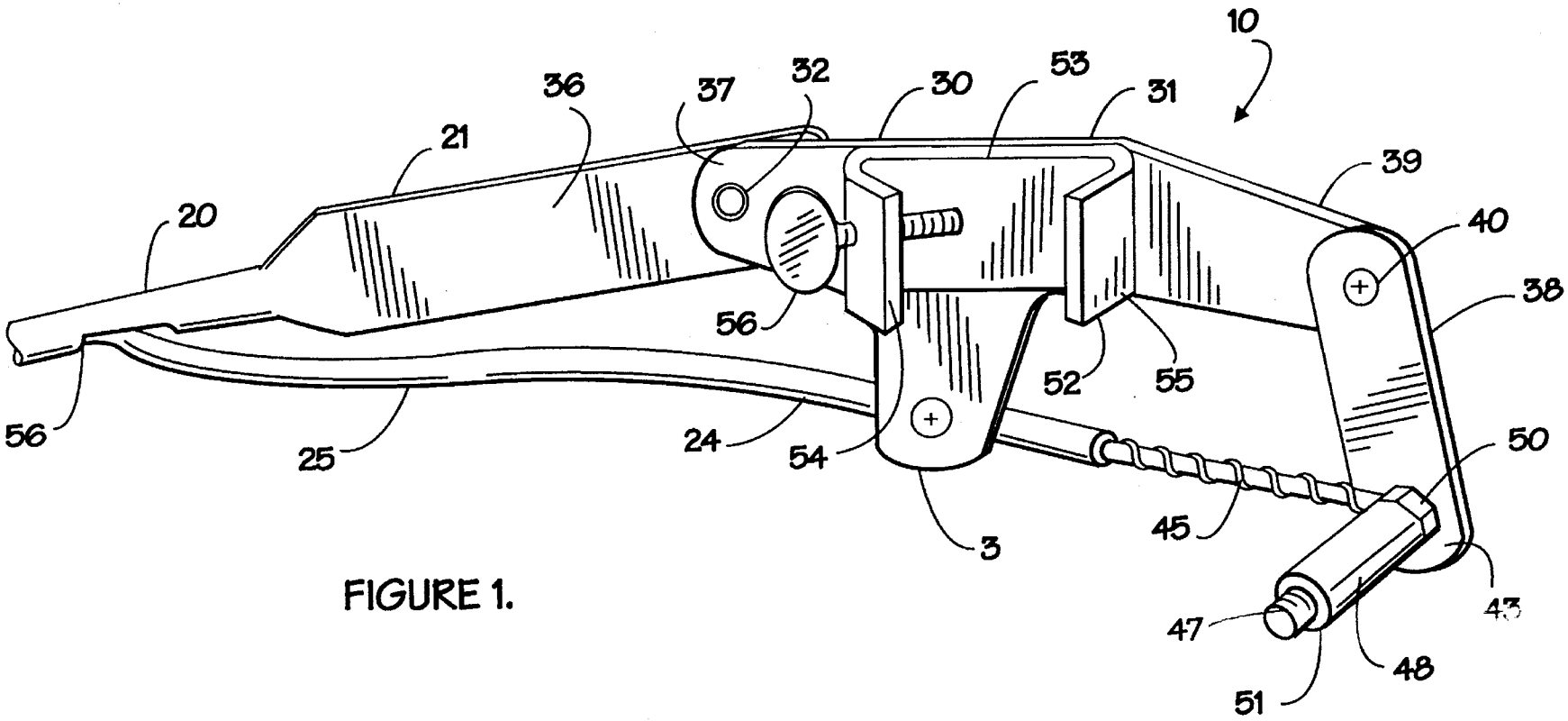
FIG. 1 is a front perspective view of the paint spray gun extender.
Figure 2:
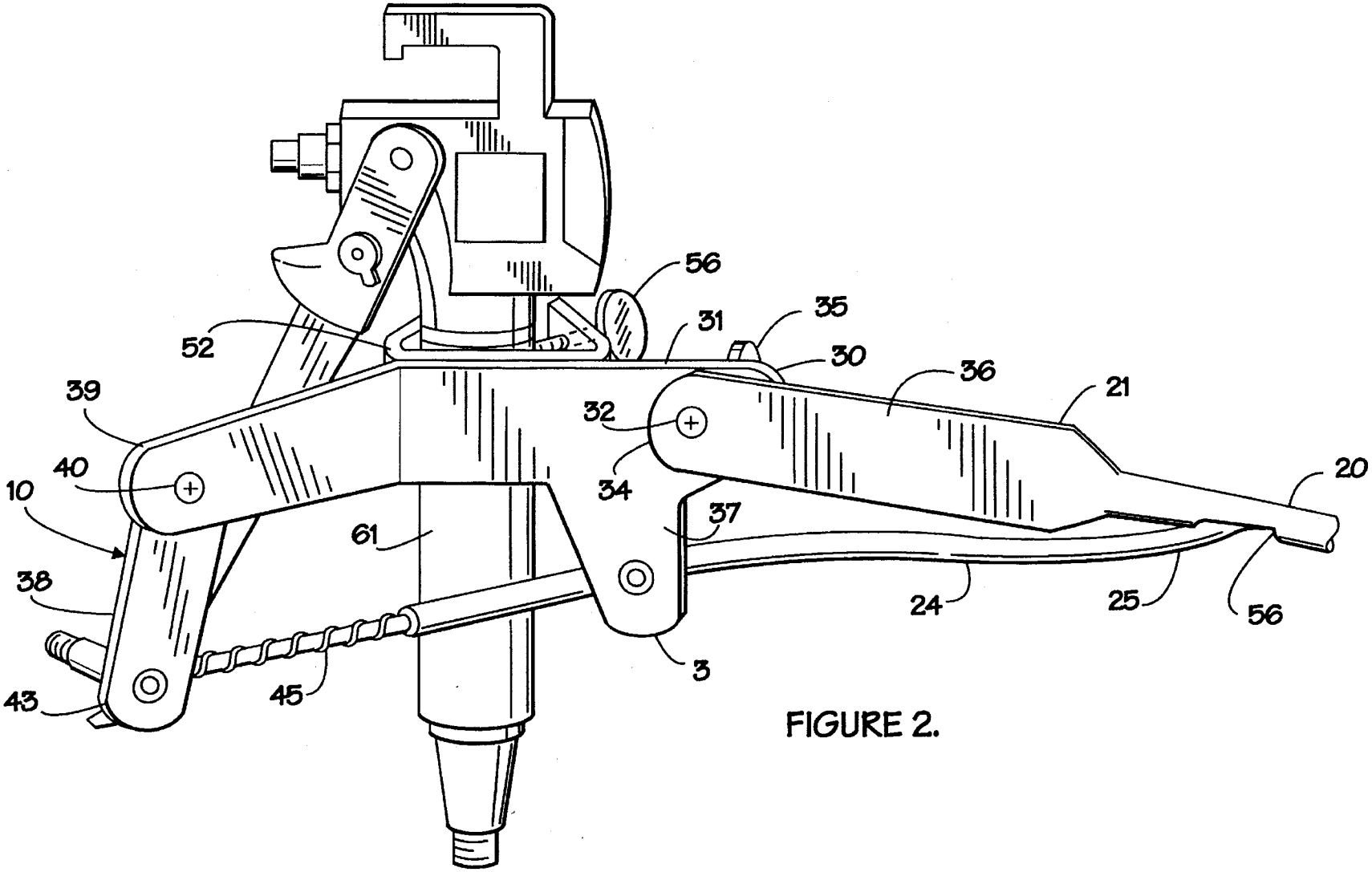
FIG. 2 is back perspective view of the invention.
Figure 3:
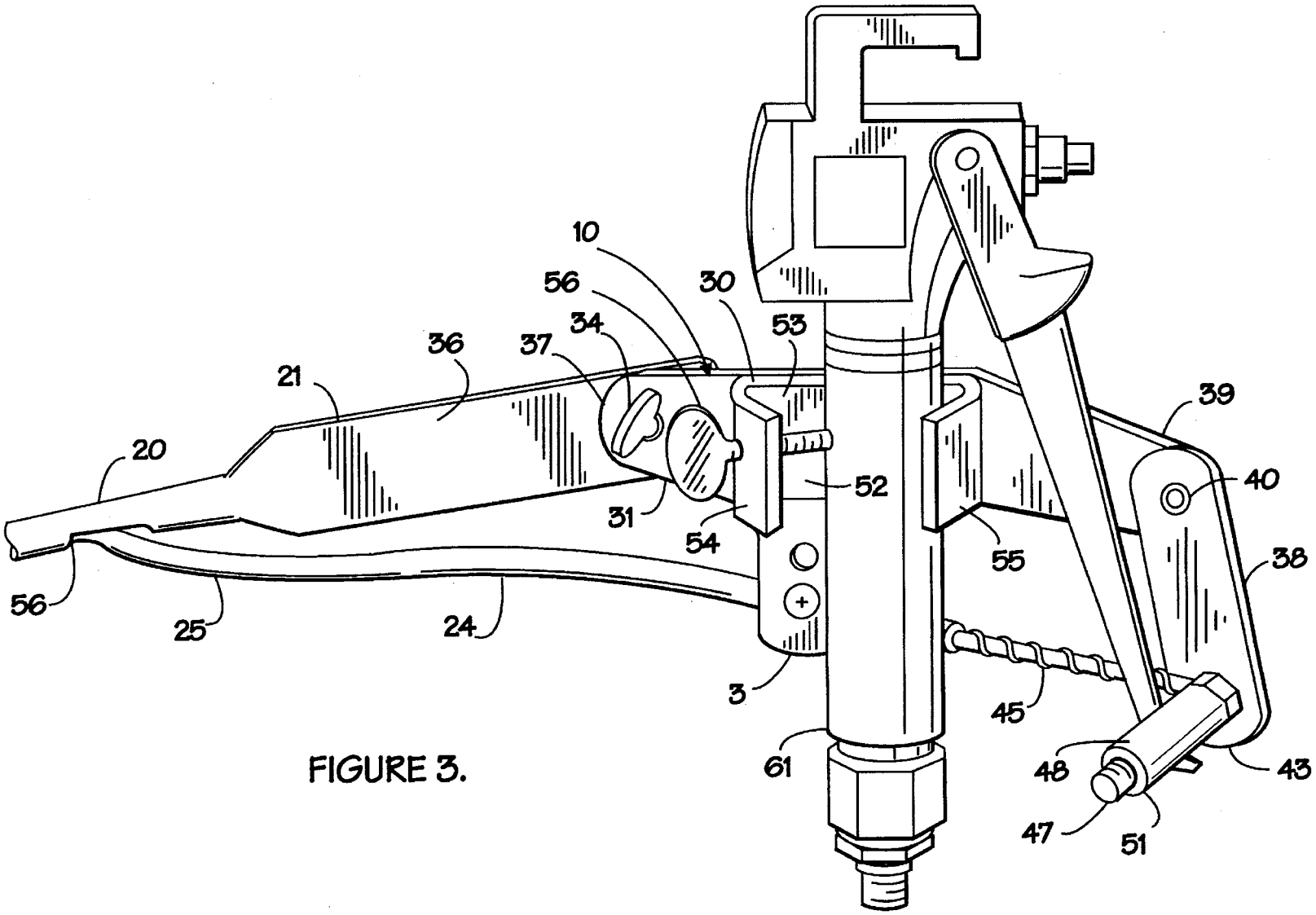
FIG. 3 is a front perspective view of the paint spray gun extender with a typical spray gun mounted in place.
Figure 4B:
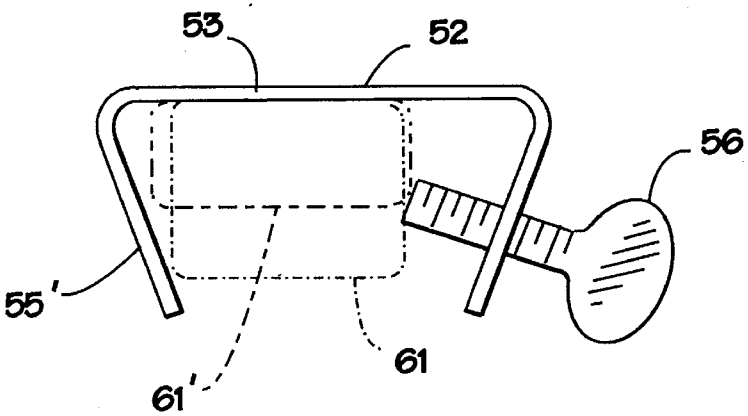
Figure 4A:
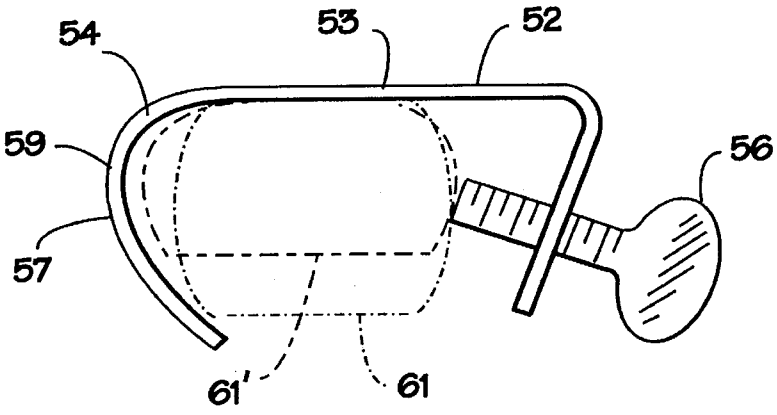
Figure 5:
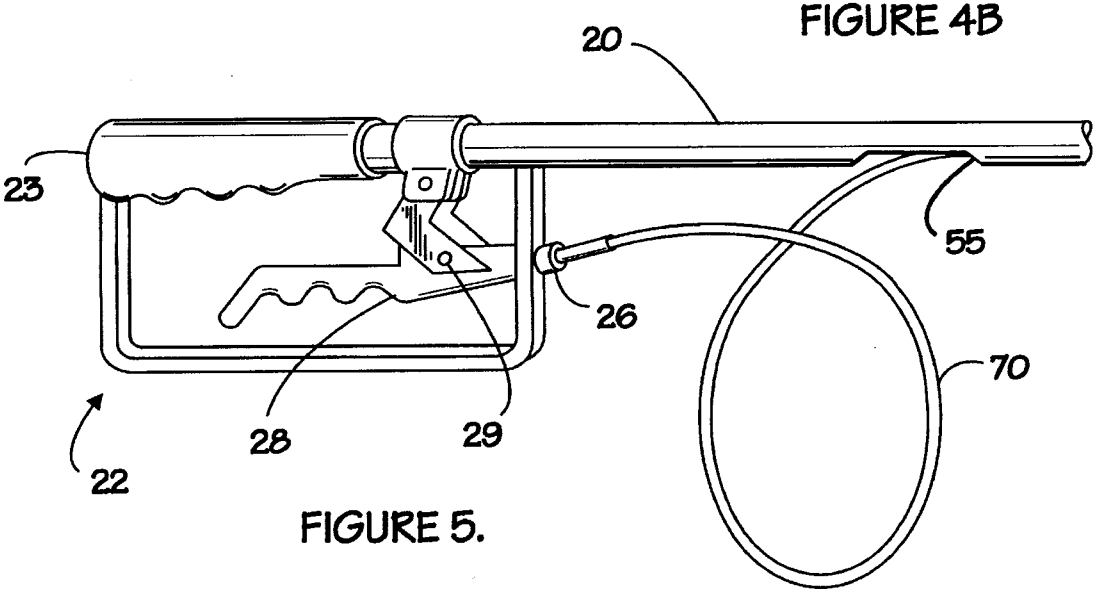

FIG. 5 is a portion of the pole showing the actuating member.

Figure 6:
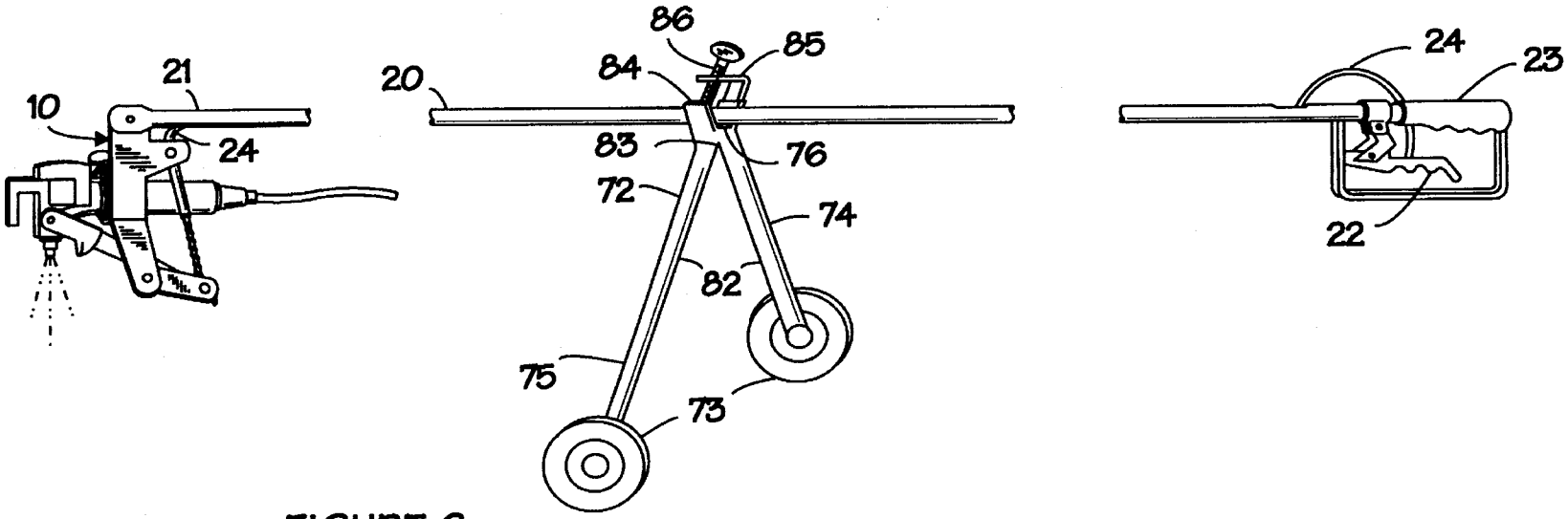

FIG. 6 is a perspective view of the extender in combination with a cart, allowing a paint spray gun to be mounted in the extender and used to paint stripes on the ground.

Figure 7:
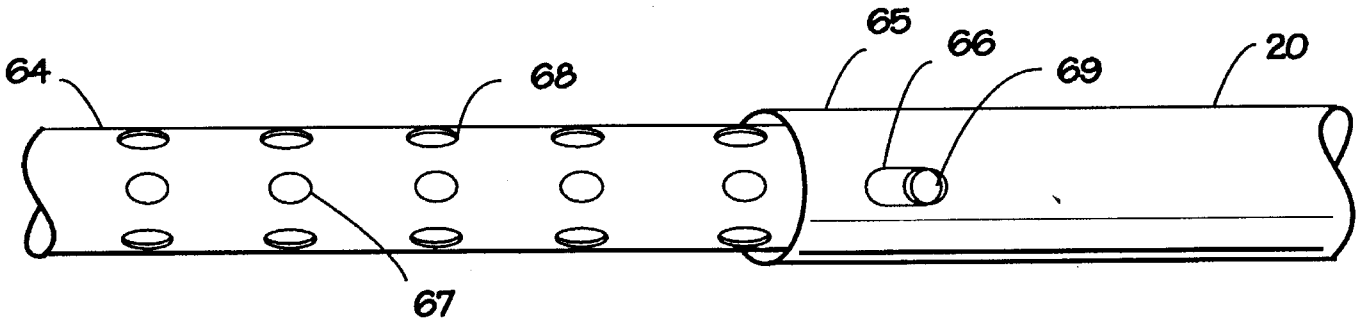

FIG. 7 is a partial view of the telescoping pole also showing circumferential holes about the inner member.

DESCRIPTION OF THE PREFERRED EMBODIMENT

Referring to the figures, the present invention is directed to a spray gun extender 10 including a pole 20, a spray gun mounting assembly 30 on a pole first end 21, and a pole actuating lever 22 on a pole second end 23 with a sheathed cable 24 running between the actuating lever 22 and the spray gun mounting assembly 30. Cable 24 is long enough to run between the actuating lever 22 and the spray gun mounting assembly 30 when fully extended with excess cable forming a loop 70 between the pole 20 and the actuating lever 22.

The pole actuating lever 22 may be of any mechanism that pulls the cable 24 through its sheath 25 but typically includes a mount bar 26 attached near the pole second end 23 with the cable 24 passing to a lever handle 28 pivoting on a pivot pin 29 in the mount bar, the cable sheath, secured to the mount bar 26 such that when the lever handle 28 is pulled generally toward the pole 20, the cable 24 is pulled through its sheath, in similar manner of a bicycle brake handle. To protect the cable 24 from spills and snags, it is typically routed through the pole 20, which is necessarily hollow to accommodate the cable 24, the cable passing into and out of the hollow pole 20 through first and second pole holes 55 and 56. The cable excess length between the pole and the actuating lever forms a loop to accommodate variation in cable length between the spray gun mounting assembly and the actuating lever by the adjustable pole length.

The spray gun mounting assembly 30 comprises a vertical support plate 31 pivotably attached to the pole first end 21 on a carriage bolt 32 passing through a plate mounting hole aligned with a pole first end hole and releasably secured therein by a wing nut 35 which tightens the support plate 31 at a selective pitch angle to the pole 20. Preferably, the pole first end 21 includes a flat mounting portion 36, and the support plate 31 includes a matching flat mounting portion 37 in face-to-face contact, the added friction of face-to-face contact of flat surfaces providing further resistance to unwanted rotation on the carriage bolt 32 when the wing nut 35 is tightened. A rubber washer 34 between them adds further resistance to rotation.

The spray gun mounting assembly 30 further comprises an arm 38 pivotably mounted on the support plate 31 near its distal end 39 through a pivot pin 40 passing through aligned holes in the arm 38 and the support plate 31, respectively, the arm extending beyond the support plate 31. The cable 24 is attached near the distal end 43 of the arm 38 using a conventional cable clip to bind the cable 24 to the arm while the cable sheath 25 is mounted to the support plate 31, preferably near the mounting carriage bolt 32, with a cable return spring 45 around the cable 24 between the sheath 25 and the cable clip such that when the cable is pulled by the lever handle, it slides within its sheath 25 against the bias of the spring 45 which urges the cable and arm to return to its rest position as before the lever handle pulls the cable 24.

A spray gun trigger actuator 46 comprises a standoff bolt 47 attached and extending approximately normal to the arm 38. A standoff sleeve 48 may be set loosely over the bolt 47, secured to the arm 38 over the standoff bolt 47 between a locking nut 50 tightened against the arm 38 and a retaining nut 51. Thus, when pulled against a spray gun trigger, the sleeve 48 rolls on the standoff bolt 47 and the trigger.

A C-shaped grip member 52 with a back 53 and extending legs 54 and 55 is secured to the support plate 31 with the back 53 against the support plate 31 and opposing legs 54 and 55 extending away from the support plate for receiving a spray gun handle simulating a hand gripping the gun handle below the gun trigger. The spray gun handle is secured in the grip member 52 by a thumb screw clamp 56 which passes through a matching threaded hole in a first extending leg 54 until tightened against the gun handle as the handle is pressed against the opposing second extending leg 55.

Second grip member extending leg 55 faces first grip member extending leg 54 with a concave curvature into which a spray gun handle is firmly held by the thumb screw clamp 56. To accommodate spray gun handles of varying size, the concave curvature has a high curvature, that is small radius, at its vertex 59 (position most distant from the opposing leg) with a decreasing curvature, that is increasing radius, extending away from the vertex 59 thus snugly receiving larger spray gun handles 61 outward in the first grip member extending leg 55 and smaller spray gun handles 61' inward in the curvature 57. In the alternative, the changing curvature may be equivalently approximated with a first grip member extending leg 55' extending acutely from the grip member back 53.

The pole 20 may be adjustable in length with a tubular inner member 64 telescoping from within an outer member 65. The inner member 64 is adjustable in extent on the outer member 65 by locking means 66. Any of several locking means may be employed, such as spring-loaded pin 69 mounted on the outer member 65 and positioned into one of a plurality of available holes or detents 67 along the length of the telescoping inner member 64. Additionally, the inner member may be rotated and locked in rotated disposition within the outer member 65 by providing a plurality of circumferential holes or detents 68 about the inner member into which the spring-loaded pin is positioned, thus advantageously rotating the spray gun mounting assembly 30 about the pole. As the pole is extended, the cable loop 70 is reduced in size as cable is pulled into the pole 20 to accommodate an extended pole length. Conversely, as the pole is reduced in length, the cable loop 70 is enlarged to absorb the excess cable not employed in the pole.

Thus, it is clear that with the grip and pole mounted on opposite sides of the support plate, the plate may obtain any pitch orientation with respect to the pole as the plate pivots unrestricted on the carriage bolt.

The spray gun extender in combination with a wheeled cart on which the pole of the extender is mounted obtains a unique line striper useful for small tasks such as spraying small store front parking stripes, apartments, condominiums, etc. specifically exploiting the capability of the extender to adjust in positive and negative pitch rotation. Thus, the spray gun extender pole 20 is removably mounted intermediate its length to a wheeled cart 72. Typically, the cart has two opposing wheels 73 on a "V"[<b]old0 shaped frame 74 with the wheels rotably attached to ends 75 of the "V" legs 82 and with the extender pole 20 attached at the "V" vertex 76. The cart legs 82 join at a junction 83 at one end of each leg, the other leg ends diverging toward the ground in the form of an inverted "V". A mounting apparatus at the leg junction includes a receptor 84 in which the pole is received, a bar 85 extending from the receptor 84 over the pole 20 with a threaded hole with a matching threading screw 86 in the threaded hole tightened against the pole to adjustably secure it in the receptacle.

Having described the invention, what is claimed is:

1. A spray gun extender for extending the reach of a paint spray gun comprising an elongate pole, a spray gun mounting assembly pivotably mounted on a pole first end, the assembly including a vertical support plate, means for pivotably mounting the vertical support plate to the pole with positive and negative pitch angle adjustment, a grip member spaced on a support plate first side a distance from the pivotably mounting means such that the grip member and supporting plate are adjustable in positive and negative pitch without the grip impacting on the pole, means for removably mounting a spray gun handle in the grip member, spray gun trigger engaging means extending away from the support plate first side for pulling the spray gun trigger removably mounted thereon, an actuating member on a pole second end for controlling the spray gun, a cable running between the actuating member and the spray gun mounting assembly for pulling the trigger engaging means when the cable is pulled by the actuating member.

2. The spray gun extender of claim 1 in which the grip member and the pole are mounted on opposite sides of the support plate such that the plate pivots with unrestricted positive and negative pitch angle rotation thereby allowing the spray gun assembly to be adjusted on the pole member substantially about 360°.

3. The spray gun extender of claim 1 wherein the spray gun trigger engaging means for pulling the gun trigger comprises an arm pivotably mounted at one end parallel to and extending beyond the support plate with the cable attached near another end of the arm, a standoff bolt attached to and extending approximately normal to the arm for placement next to a spray gun trigger.

4. The spray gun extender of claim 3 further comprising a sheath on the cable, sheath attaching means securing the sheath to the support plate, a cable return spring around the cable between the sheath and the arm such that when the cable is pulled by the actuator member, the cable slides within its sheath against the bias of the spring thereby urging the cable and arm to return to a rest position.

5. The spray gun extender of claim 1 in which the means for mounting the support plate adjustably to the pole first end with positive and negative pitch angle adjustment comprises a flat mounting portion on the pole first end with a mounting hole, a matching flat mounting portion on the support plate with a mounting hole, a carriage bolt passing through mounting holes, a nut on the carriage bolt releasably securing the support plate at a selective pitch angle to the pole member with the flat mounting portions in face-to-face contact.

6. The spray gun extender of claim 1 wherein the grip member further comprises a back secured to the support plate first side, first and second opposing legs spaced apart by the back and extending from the support plate first side, means for removably securing a spray gun handle in the grip member between the opposing legs.

7. The spray gun extender of claim 6 wherein the means for removably securing a spray gun handle in the grip member between the opposing legs includes a threaded hole in a first extending leg, and a matching thumb screw clamp passing through the threaded hole until tightened against the gun handle as the handle is pressed against the opposing second extending leg.

8. The spray gun extender of claim 6 in which the second extending leg of the grip member further comprises a concave curvature sized to receive a spray gun handle and held therein by the thumb screw clamp.

9. The spray gun extender of claim 8 in which the second extending leg curvature is decreasing toward the first extending leg for snugly receiving a larger spray gun handle outward in the second extending leg and a smaller spray gun handle more inward in the curvature.

10. The spray gun extender of claim 6 in which the second extending leg extends acutely from the grip back toward the first extending leg.

11. The spray gun extender of claim 3 in which the grip member and the arm are dismountable from the support plate and the support plate is similarly dismountable from the pole first end such that the extender may be reconfigured with the arm above or below the support plate.

12. The spray gun extender of claim 1 further comprising means for adjusting the pole in length.

13. The spray gun extender of claim 12 in which the means for adjusting the pole in length comprises a tubular outer member with an inner member telescoping from within the outer member, and locking means for securing the inner member within the outer member at a selective length.

14. The spray gun extender of claim 13 in which the locking means for securing the inner member within the outer member at a selective length comprises a plurality of available holes or detents along the length of the telescoping inner member, and a spring-loaded pin mounted on the outer member and positioned into a selective hole or detent.

15. The spray gun extender of claim 14 in which additional holes or detents are located circumferentially about the telescoping inner member such that it can be locked in rotated disposition about the outer member.

16. The spray gun extender of claim 12 in which cable excess between the pole and the actuating lever forms a loop to accommodate variation in cable length between the spray gun mounting assembly and the actuating lever by the adjustable pole length.

17. The spray gun extender of claim 1 in combination with a mobile wheeled cart forming a line striper useful for applying stripes on a ground surface, comprising means for mounting the spray gun extender on the wheeled cart with the pole of the spray gun extender extending approximately horizontally from the cart with the spray gun mounting assembly adjusted toward a ground surface.

18. The combination of claim 17 in which the wheeled cart comprises a cart frame including two legs joined at a junction at one end of each leg, the other leg ends diverging toward the ground in the form of an inverted "V", a mounting apparatus at the leg junction including a receptor in which the pole is received, and means for securing the pole in the receptacle.

19. The spray gun extender of claim 1 in which the means for pivotably mounting the vertical support plate to the pole with positive and negative pitch angle adjustment comprises a pivot carriage bolt passing through matching holes in the pole first end and supporting plate with the plate mounted in side-by-side disposition to the pole such that the plate can rotate about the pivotably mounting means unrestricted by the pole.

20. The spray gun extender of claim 2 further comprising means for securing the support plate to the pole first end on the pivotably mounting means in an selective relative pitch position.

* * * * *